US010773483B2

(12) United States Patent
Paolinelli et al.

(10) Patent No.: US 10,773,483 B2
(45) Date of Patent: Sep. 15, 2020

(54) MAGAZINE FOR EMBOSSING ROLLERS AND EMBOSSING DEVICE COMPRISING THE MAGAZINE

(71) Applicant: Fabio Perini S.p.A., Lucca (IT)

(72) Inventors: Alessio Paolinelli, Capannori (IT); Alessandro Muchetti, Capannori (IT); Mauro Ricci, S. Pietro a Vico (IT)

(73) Assignee: Fabio Perini S.p.A., Lucca (IT)

( * ) Notice: Subject to any disclaimer, the term of this patent is extended or adjusted under 35 U.S.C. 154(b) by 245 days.

(21) Appl. No.: 16/087,764

(22) PCT Filed: Mar. 21, 2017

(86) PCT No.: PCT/EP2017/056647
§ 371 (c)(1),
(2) Date: Sep. 24, 2018

(87) PCT Pub. No.: WO2017/162640
PCT Pub. Date: Sep. 28, 2017

(65) Prior Publication Data

US 2019/0111651 A1 Apr. 18, 2019

(30) Foreign Application Priority Data

Mar. 25, 2016 (IT) ..... UA2016A002030

(51) Int. Cl.
*B31F 1/07* (2006.01)
*B31F 1/28* (2006.01)

(52) U.S. Cl.
CPC ..... *B31F 1/07* (2013.01); *B31F 1/2868* (2013.01); *B31F 2201/0753* (2013.01); *B31F 2201/0776* (2013.01)

(58) Field of Classification Search
CPC ..... B31F 2201/0776; B31F 2201/0753; B31F 1/2868
See application file for complete search history.

(56) References Cited

U.S. PATENT DOCUMENTS 5,274,956 A * 1/1994 Figge ..... B21B 13/20 198/346.2
6,688,366 B1 * 2/2004 Gambini ..... B31F 1/07 156/209
2018/0178498 A1 * 6/2018 Gussert ..... B32B 37/0053

FOREIGN PATENT DOCUMENTS

EP 3272512 A1 * 1/2018 ..... B31F 1/07
GB 2373482 A 9/2002
WO 2015150452 A1 10/2015

* cited by examiner

*Primary Examiner* — Jennifer E Simmons
(74) *Attorney, Agent, or Firm* — Breiner & Breiner, L.L.C.

(57) ABSTRACT

The magazine for embossing rollers includes a plurality of support seats for embossing rollers, adjacent to one another according to an alignment direction. The magazine further includes a guide system for guiding the seats in a handling direction. The seats are provided with mutual connecting members so as to be connected to, and released from, one another.

17 Claims, 10 Drawing Sheets

41
43
V
R
45
19A
5
9
5
11
250
249
250
249
250
15
C
247
1
1
7
3
2
R
f247
2
2
IIIA
250
249
C
250
249
250
13
19B
5
9
11
IIIA
VI
P
45
5
5C
33A
33B
31B
VII
31A
F
VII
29
29

21
33A
33B
17
17
5
9
5
11
250
249
250
249
15
1
F
247
41
43
7
P
45
2
3
2
19A
C
250
2
250
249
R
250
249
13
C
5
5
9
11
17
17
C
250
19B
31A
31B
29
29
P

MAGAZINE FOR EMBOSSING ROLLERS AND EMBOSSING DEVICE COMPRISING THE MAGAZINE

FIELD OF THE INVENTION

The present invention relates to improvements to the field of machines for processing web material, for example, and especially, a multi-ply cellulose material. More in particular, the invention relates to improvements to embossing machines or devices, especially for tissue paper, and to the parts or components thereof.

BACKGROUND ART

In the production of cellulose ply material, for example rolls of toilet paper, rolls of kitchen towels, paper handkerchiefs, paper napkins and the like, a cellulose ply is usually embossed, by passing it through an embossing nip formed by a pair of steel rollers or by a pair constituted by a roller made of steel or other relatively rigid material and a roller coated with a yielding material like rubber. The steel roller has protuberances entering the elastically yielding coating of the pressure roller. The pressure between the embossing roller and the pressure roller causes the permanent deformation of the web of cellulose material which passes through the embossing nip between the embossing roller and the pressure roller. Two or more plies, at least one of which, or some of which, or all are embossed, are then bonded together in order to for a multi-ply web material. The web material may be wound in order to form rolls, or it may be cut and folded to form napkins, handkerchiefs and the like.

Each ply can in turn be composed of one or more layers of cellulose material.

The embossing pattern has both decorative and functional purposes. From a functional viewpoint, the embossing creates limited areas, onto which glue is applied for bonding together multiple plies forming the web material. A further purpose of embossing is to increase the overall thickness of the web material, to increase the softness and the absorption capacity thereof, as well as to increase other functions thereof known to those skilled in the art.

Generally speaking, an embossing device is a device performing an embossing processing on at least one ply and, in case, bonding two or more plies together by means of lamination, for example using glue applied on at least one of the plies, preferably on the top surfaces of at least some embossing protuberances formed on one or more plies.

In order to satisfy the needs of the modern tissue paper processing lines, it is necessary to replace the embossing rollers of the embossing device, with the purpose of both changing the pattern of the web material, and modifying the technical and functional features thereof, for example to switch from manufacturing of toilet paper to manufacturing of kitchen towels and vice versa. In fact, since embossing has not only aesthetical purposes but also, in some cases, functional purposes, embossing patterns suitable for manufacturing of toilet paper are not always suitable for manufacturing kitchen towels, and vice versa. Also consistency, grammage and content of the cellulose plies may differ depending on the type of articles to be produced, and different embossing patterns may be required for different products.

Embossing units or devices have been studied, having particular solutions for making the roller replacement simpler and quicker.

WO-A-2015/150452 discloses examples of embossing or embossing-laminating devices, provided with a magazine for interchangeable embossing rollers. In this way, it is possible to replace the embossing roller(s) mounted in the embossing device with other embossing rollers stored in the magazine. A specific handling member is provided to this end, transferring embossing rollers from the magazine to the supports for the embossing rollers, with which the embossing device is equipped, and vice versa. In some embodiments disclosed in WO-A-2015/150452 a magazine for embossing rollers is provided, comprising a carriage provided with a plurality of embossing roller support seats adjacent to one another according to an alignment direction, and a guide system for guiding the carriage in a handling direction parallel to the alignment direction of the support seats.

This magazine is particularly useful for making the embossing device more efficient and versatile, allowing the embossing rollers to be replaced quickly.

However, there is still a need for further improvements of embossing roller magazines, and embossing devices comprising said magazines, in order to make the replacement of the embossing rollers easier, more effective and quicker, further increasing the performance of the embossing device.

SUMMARY OF THE INVENTION

According to one aspect, a magazine for embossing rollers is disclosed, comprising a plurality of support seats for embossing rollers, adjacent to one another according to an alignment direction. A guide system is also provided, for guiding the seats in a handling direction. The movement according to the handling direction allows selectively to move each seat to a given station, for instance to a station where an embossing roller may be taken from said seat and inserted into an embossing device, or where an embossing roller taken from an embossing device may be arranged into the magazine seat. Moreover, or alternatively, the station may be a station where the seats can be extracted from the magazine and inserted therein, in order to extract single rollers from the magazine or to insert them therein. The seats may be provided with mutual connecting members so as to be connected to, and released from, one another. In some embodiments, the mutual connecting members are so configured as to allow mutually to connect and release the seats by means of a fastening and releasing movement according to an insertion and extraction direction, not parallel to the handling direction. This may be essentially achieved by means of a shaped-coupling, for instance by means of shaped profiles provided on the seats that mutually couple and mutually release through the movement of one seat with respect to the other.

According to a further aspect, an embossing device is disclosed comprising:

at least one embossing roller provided with embossing protuberances;

at least one pressure roller defining, with the embossing roller, an embossing nip;

a magazine for embossing rollers as defined above.

Advantageously, the magazine for embossing rollers may be integrated in a bearing structure of the embossing device. The bearing structure may also, directly or indirectly, support a handling member configured and arranged to extract single rollers from the magazine and to transfer them to an operative position, for instance in operative seats provided in the bearing structure, as well as to remove single embossing rollers from an operative position and transfer them to the magazine.

Thanks to a magazine and an embossing device of the type described above, a significant operational flexibility of the embossing device can be achieved. The magazine may allow the extraction and the insertion of single embossing rollers, while the embossing unit is operating. In this way, it is possible to use a high number of embossing rollers in combination with the same embossing device, thus achieving high operational flexibility. Moreover, the embossing rollers may be replaced on the embossing device simply and quickly, thus increasing, with respect to known solutions, the number of embossing rollers that can be alternatively used on the same embossing device, reducing the maintenance times as much as possible and, thus, the downtimes and the consequent production losses.

Thanks to the magazine and the systems for extracting the embossing rollers therefrom, it is also possible to clean, repair and, in general, maintain the embossing rollers combined with the embossing device, while this latter is operating.

According to a further aspect, a method is provided for managing an embossing device, wherein the embossing device comprises: a bearing structure; at least one embossing roller provided with embossing protuberances; at least one pressure roller defining, with the embossing roller, an embossing nip; a magazine for embossing rollers integrated in the bearing structure; a handling member movably arranged on the bearing structure in order to transfer single embossing rollers from an operative position to the magazine seats, and vice versa. The method may advantageously comprise the following steps:

feeding at least one ply of web material through the embossing nip and embossing the ply of web material by means of the embossing roller and the pressure roller;

extracting one or more embossing rollers from, and/or inserting them into, the magazine while the ply of web material is embossed.

Further advantageous features and embodiments of the magazine and the embossing device incorporating are set forth in the attached claims, which form an integral part of the present description.

BRIEF DESCRIPTION OF THE DRAWINGS

The invention will be better understood by following the description and the accompanying drawing, which shows non-limiting practical embodiments of the invention. More particularly, in the drawing.

DETAILED DESCRIPTION OF EMBODIMENTS

FIGS. 1, 1A, 1B, and 2 show an embodiment of an embossing device where a magazine for embossing rollers according to the present invention may be incorporated. The embossing device described herein comprises two embossing rollers and two pressure rollers, as well as a gluing unit, in order to produce glued multi-layer web material. However, it should be understood that the novel features of the magazine for embossing rollers described below may be advantageously used also in embossing devices of different type, for example in embossing devices without a gluing unit, or in embossing devices equipped with only one embossing roller and one pressure roller, or in embossing devices with more than two pairs of embossing rollers and pressure rollers cooperating together.

Figure 1:
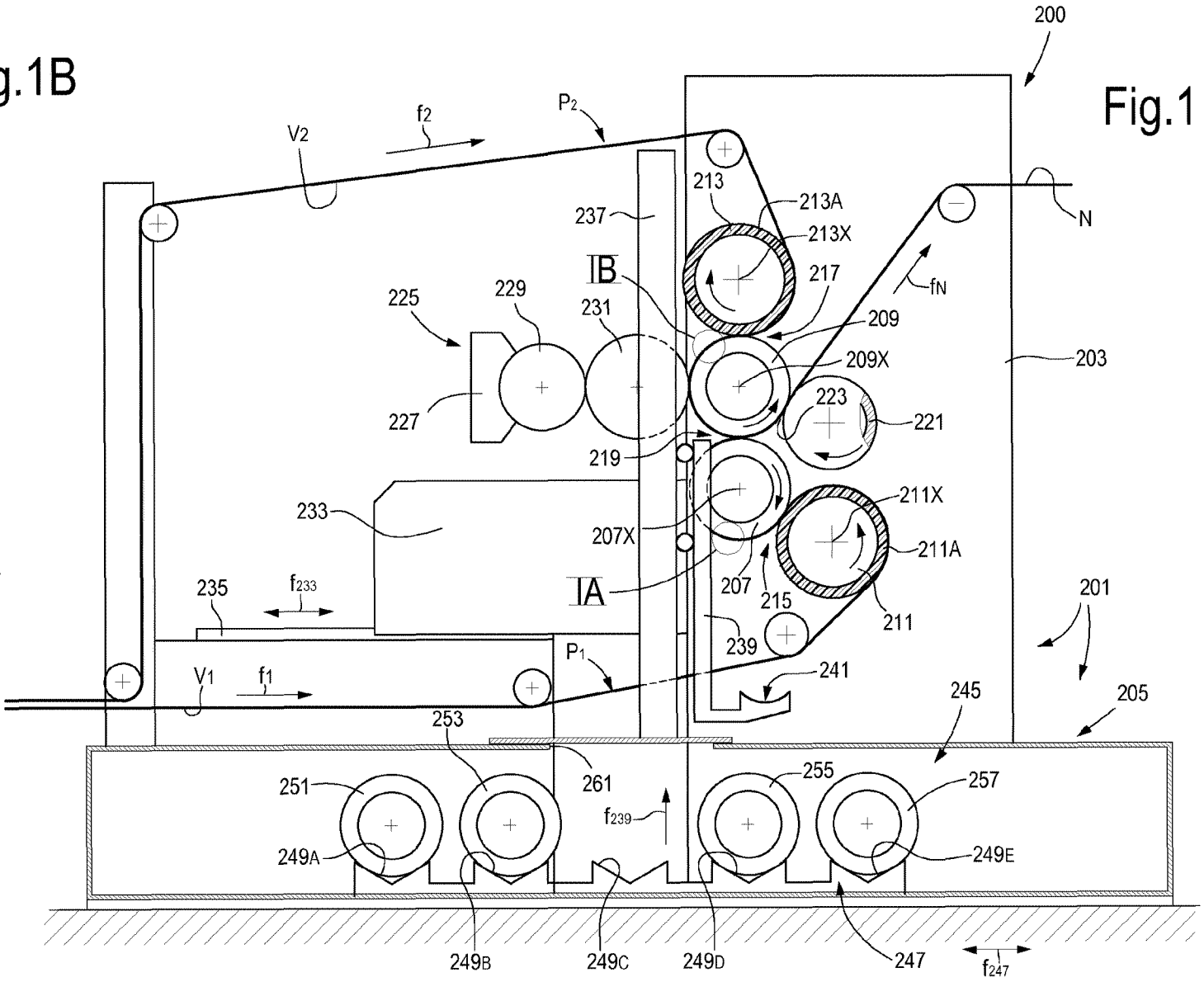
FIG. 1 is a side view of an embossing device, where a magazine according to the invention may be inserted.
Figure 2:
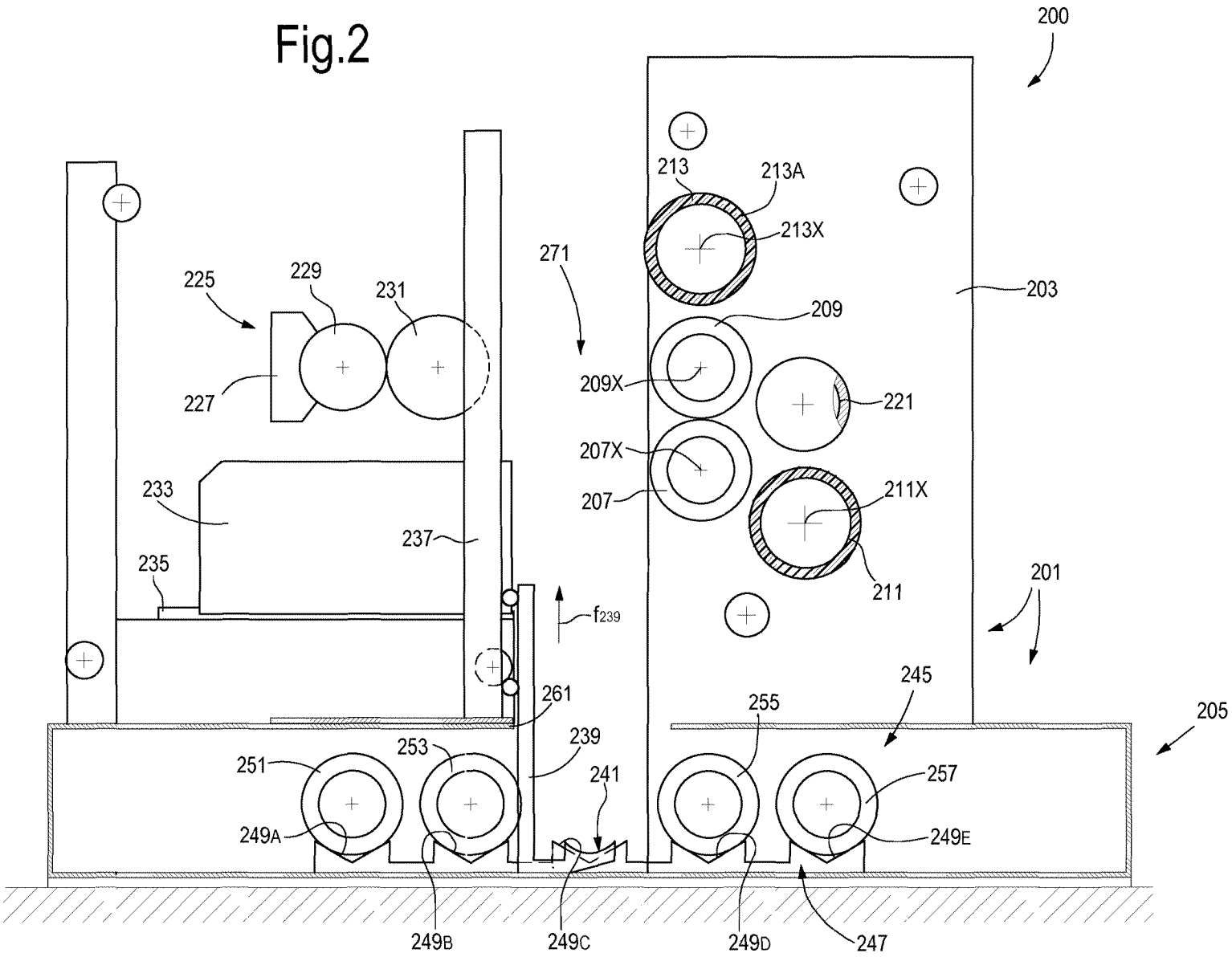
FIG. 2 shows a step of a cycle for replacing an embossing roller in the embossing device of FIG. 1.

FIGS. 1 and 2 show a schematic side view of the embossing device. More in particular, FIG. 1 shows an embossing device 200 during a step of production of a web material N. The web material N may be obtained by bonding two continuous plies V1, V2. In FIGS. 1, P1 and P2 indicate, as a whole, two paths of the plies V1 and V2. In other embodiments, the number of plies of the web material N may be greater than two, and more than two feeding paths may be provided for the plies.

Each ply V1, V2 may be formed by one or more layers, sheets or components put over one another and, in case, bonded to one another, for example by means of a ply-bonding unit or an embossing unit arranged upstream of the embossing device 200.

In the illustrated embodiment, the embossing device 200 has a bearing structure indicated as a whole with number 201. The bearing structure may comprise two side flanks 203 and a base structure 205.

Figure 1B:
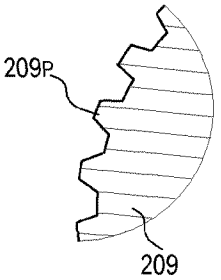
FIGS. 1A, 1B are enlargements of details indicated with IA and IB in FIG. 1.
Figure 1A:
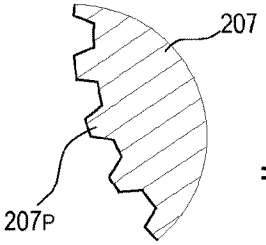

In some embodiments, a first embossing roller 207 and a second embossing roller 209 may be arranged between the two flanks 203 of the bearing structure 201. The first embossing roller 207 may be provided with embossing protuberances 207P, as shown in the enlarged detail of FIG. 1A, while the second embossing roller 209 may be provided with embossing protuberances 209P, as shown in the enlargement of FIG. 1B.

The first embossing roller 207 may co-act with a first pressure roller 211. In some embodiments, the pressure roller 211 may be coated with an outer layer 211A made of a yielding material, preferably a resiliently yielding material, for example rubber. The second embossing roller 209 may co-act with a second pressure roller 213. In some embodiments, also the pressure roller 213 may be coated with an outer layer 213A made of a yielding material, especially a resiliently yielding material.

207X, 209X, 211X and 213X indicate the rotation axes of the two embossing rollers 207, 209 and of the two pressure rollers 211, 213, respectively. These axes are substantially parallel to one another.

Between the first embossing roller 207 and the first pressure roller 211 a first embossing nip 215 is formed, through which the first ply V1 passes for being embossed by means of the protuberances 207P of the first embossing roller 207. If the pressure roller 211 is provided with an outer yielding coating 211A, the protuberances 207P are pressed against the first pressure roller 211 and enter into the yielding coating 211A, thus deforming the ply V1 permanently.

Between the second embossing roller 209 and the second pressure roller 213 a second embossing nip 217 is formed, through which the second ply V2 passes. The second ply V2 is embossed analogously to the first ply V1, due to the effect of the protuberances 209P of the second embossing roller 209 that are pressed against the second embossing roller 213. If this second embossing roller is provided with an elastically yielding coating 213A, the embossing protuberances 209P penetrate the yielding coating and cause permanent deformation of the ply V2.

The two pressure rollers 211, 213 may be supported by means of arms or other members, that allow a movement thereof towards or away the respective embossing rollers 207, 209, for the purposes that will be explained below. Actuators (not shown), for example cylinder-piston actuators, may be used to press the pressure roller 211 against the first embossing roller 207 and the second pressure roller 213 against the second embossing roller 209.

In some embodiments, the two embossing rollers 207, 209 may be configured to operate in a tip-to-tip way, i.e. with the protuberances 207P, 209P arranged opposite to one another in order to press the plies of web material against one another in the nip 219 formed between the two embossing rollers 207, 209.

In other embodiments, the embossing device 200 may comprise a laminating roller 221, pressed against the embossing roller 209 and forming a lamination nip 223 therewith. In this way, the two plies V1 and V2 may be laminated between the second embossing roller 209 and the laminating roller 221. In the nip 219, the embossing rollers 207, 209 are slightly spaced from each other, so that the two plies V1, V2 do not touch each other. In this case, the embossing device may generate a material embossed according to the so-called nested technique, with embossing protuberances of the ply V2 nested between embossing protuberances of the ply V1, and vice versa.

In some embodiments, the embossing device 200 may be configured to operate in the tip-to-tip mode and in the nested mode, alternatively. To this end, the embossing rollers may be, for example, movable angularly around their axes and/or parallel to their axes, and the laminating roller may be alternatively moved between an active position and an inactive position.

The embossing device 200 may comprise a glue dispenser 225. The glue dispenser 225 may comprise a glue source 227, a first screened roller or anilox roller 229, which picks up glue from the glue source 227, and a second plate roller or applying roller 231, which receives glue from the screened roller 229 and distributes glue on portions of the embossed ply V2 adhering to the second embossing roller 209. Generally, glue is applied at at least some front surfaces of the embossing protuberances 209P, with which the embossing roller 209 is provided, on the portions of ply embossed by means of the embossing protuberances 209P.

In some embodiments, the glue dispenser 225 is mounted on a slide or carriage 233 movable according to the double arrow f233, for example along guides 235 carried by an element of the fixed structure 201. The movement according to the double arrow f233 may be controlled by means of a suitable actuator, for example a cylinder-piston actuator, an electric motor, or any other suitable actuator, not shown.

In some embodiments, one or more uprights 237 are associated with the carriage 233, which extend substantially vertically and onto which guides may be provided for the movement of a slide 239 according to the double arrow 2239 along the upright(s) 237. In some embodiments, two uprights 237 may be provided, arranged near the flanks 203. A respective slide 239 may be arranged on each upright. In the drawing, only one upright and one slide are shown, and it shall be understood that the second upright and the second slide are behind the upright and the slide shown in the drawing.

A suitable actuator (not shown) may be provided to control the upward and downward movement of the slide 239 or of each slide 239 according to the double arrow f239. For example, to this end a threaded bar may be provided, actuated by means of a motor, for instance an electric or a hydraulic motor. A nut screw carried by the slide may mesh the threaded bar. In other embodiments, a mechanism may be provided, comprising a toothed belt or other continuous flexible member, driven around pulleys, at least one of which is motorized. The slide 239 may be fastened to a branch of the continuous flexible member, so that the movement of the belt causes the movement of the slide in vertical direction. In further embodiments, the vertical movement of the slide 239 or of each slide 239 may be provided by means of a rack-and-pinion mechanism, for example by arranging a fixed rack on the upright 237 and a motorized pinion on the slide. If two uprights and two slides are provided, the lifting and lowering mechanisms may be double, for the two slides and suitably coordinated and electronically synchronized, in order to simultaneously lifting and lowering the two slides 239.

In advantageous embodiments, each slide 239 carries a respective handling member 241 for moving the embossing rollers in order to replace the embossing roller 207 and/or 209 mounted in the embossing device 200 with other embossing rollers housed in a magazine described below. In case two or more slides 239 are provided, the set of handling members 241 forms a handling device for moving the embossing rollers.

As it will be clearly apparent from the description below of an embossing roller replacing cycle, the handling device 241 is provided with a composite movement, for example advantageously according to a horizontal direction and a vertical direction. This allows to move the embossing roller away from the respective pressure roller and/or from the other embossing roller, up to a position where the embossing roller may be transferred to the magazine by means of a downward translation movement.

The movement of the carriage 233 according to double arrow f233 causes the horizontal movement also of the upright (2) 237, as it is visible by comparing FIGS. 1 and 2 showing two possible positions of the carriage 233. Consequently, also the slide(s) 239 and the handling device 241 may horizontally translate together with the carriage 233.

Moreover, as described above, the slide(s) 239 may be movable for example between a lower position and an upper position.

The slide(s) 239, and consequently the handling device 241, are therefore provided with a movement according to two translation axes orthogonal to each other, respectively a horizontal axis and a vertical axis, in order to move the embossing rollers so as to replace them, according to a cycle described below.

A magazine 245 for a plurality of interchangeable embossing rollers may be associated with the base structure 205, wherein each roller may replace one or the other of the two embossing rollers 207, 209, which in the arrangement of FIG. 1 are mounted between the flanks 203 of the bearing structure 201.

In the illustrated embodiment, the magazine 245 is contained inside the base structure 205. In some embodiments, the magazine 245 may comprise a carriage 247 provided with a translation movement according to a movement direction indicated by the double arrow f247, in order to allow to select one or the other of the replacement interchangeable embossing rollers contained in the magazine 245. As will be clearly apparent from the description below, the movement direction according to the double arrow f247 allows to position an embossing roller, i.e. a seat of the carriage, in a station 21 (FIG. 4) for extracting the rollers from and inserting them into the magazine. In this way, single rollers can be extracted from the magazine, and inserted therein, also while the embossing device 200 is operating.

In the illustrated embodiment, the magazine 245 comprises five for embossing roller support seats, the seats being indicated with 249A, 249B, 249C, 249D and 249E. In the configuration of FIG. 1, the magazine 245 contains four embossing rollers 251, 253, 255 and 257 housed respectively in the support seats 249A, 249B, 249D and 249E. In the condition of FIG. 1, the intermediate seat 249C is empty and is arranged in a central position, approximately below the gluing roller 231.

As shown in FIG. 1, in this embodiment the base structure 205 has, in the direction f247, a larger dimension than the length of the carriage, so that the carriage can move inside the base stricture 205 in order to bring one or the other of the seats 249A-249E in correspondence of a passage 261 that may be formed in the upper part of the base structure 205 by moving the carriage 233 away from the embossing rollers 207, 209. The embossing rollers are transferred to and from the magazine 245 through the passage 261, as explained below.

The embossing rollers 207, 209 that are in the machine, in a working position, may be integrally contained between the flanks 203. The embossing rollers 207, 209 may be advantageously held and driven into rotation by means of centers (not shown) mounted on the flanks 203. In other embodiments, the embossing rollers may be supported by known openable supports in order to extract the embossing roller from and to insert it in the embossing device. Examples of embodiments of the centers and the openable supports are described in WO2015/150452, the content whereof is integrally incorporated in the present description.

Generally, the handling device 241 is configured to engage any one of the embossing rollers 207 or 209, 251-257 and to move them as described below, in order to replace one or the other of the embossing rollers 207, 209, or both them, that are in the machine, with one or the other of the embossing rollers 251-257 that are in the magazine 245.

In FIG. 1 the embossing device 200 is shown in operational condition, with the first ply V1 and the second ply V2 moving forward according to the arrows f1 and f2 towards the embossing rollers in order to be separately embossed between the pairs of rollers 207, 211 and 209, 213. The embossed plies are glued and laminated between the embossing roller 209 and the laminating roller 221, and consequently form a multi-ply web material N moving forwards according to arrow fN towards a downward station, for example a rewinding station, not shown. The pressure roller 213 is pressed against the embossing roller 209, while the pressure roller 211 is pressed against the embossing roller 207 and the laminating roller 221 is pressed against the embossing roller 209 in order to couple the plies V1, V2 together.

When one or both the embossing rollers 207, 209 shall be replaced with other embossing rollers arranged in the magazine 245, first of all feeding of the plies V1, V2 is interrupted and the movement of the various rollers of the embossing device 200 is stopped. The carriage 233 may be moved away from the embossing rollers 207, 209 and from the pressure rollers 211, 213. FIG. 2 shows the step wherein the carriage 233 has been moved away from the pair of flanks 203 and from the embossing rollers 207, 209, thus leaving a passage 271 above the empty seat 249C of the magazine 245.

In the following step, the handling device 241 may be lifted from the lower position, inside the base structure 205 or in the space thereof, where it remains housed during the normal operation of the embossing device 200. The handling device 241 is lifted up to a position where the support elements 241A are approximately at the same height of the collars or annular projections 265 of the upper embossing roller 209. For a detailed description of the following operations, reference shall be made to what has been disclosed in WO-A-2015/150452.

In other embodiments, the handling member 241 and the moving systems thereof may be configured such that the handling member may remain outside the magazine when this latter is closed and the embossing device 200 is operating. In this way, the interior of the magazine as well as the rollers contained therein are better protected against penetration of cellulose fibers or other debris generated by processing of the plies V1, V2 of web material.

In order to increase flexibility and performances of the magazine 245, a novel structure is provided for the carriage 247 carrying the seats 249A-249E and shown only schematically in FIGS. 1 and 2. The details of the magazine 245 will be described below with reference to FIGS. 3-11.

Generally speaking, the carriage 247 of the magazine 245 may be subdivided into single sections, which can be connected to one another, and released from one another. A position of the magazine 245 forms a station for extracting and inserting single sections of the carriage 247, each of which has at least one seat for a respective embossing roller. In this way, it is possible to extract single sections of the carriage 247 from the magazine in a position for loading and unloading the embossing rollers. In this position it is possible, for instance by means of a bridge crane, to remove the embossing roller arranged in the seat extracted from the magazine and replace it with another one. All these operations may be performed while inside the magazine there is still a number of sections of the carriage suitable to allow both the operation of the embossing unit, and the replacement of the mounted and working embossing rollers with the rollers arranged in the seats of the sections of the carriage that are still inside the magazine. More in particular, the carriage sections may be extracted and inserted again while the embosser is regularly operating with the embossing rollers mounted in the embosser. Therefore, the embosser works independently of the operations performed on the replacement rollers inside or outside the magazine. The only step where the magazine and the embosser cooperate is the step of replacing one or both the embossing rollers.

More in particular, according to some embodiments, the carriage 247 comprises a plurality of sections 1, each of which comprises members defining at least one seat 249 for an embossing roller. The seat may be formed by two opposite pairs of support surfaces, each pair defining a cradle for supporting the respective roller R arranged on the section 1 of the carriage 247. In the illustrated embodiment, each roller R is provided with support bearings C, which remain connected to the rotation journal P of the roller and are therefore removed from the embossing device 200 together with the roller R. In the illustrated embodiment, each seat 249 is configured to support the respective bearing C of the roller R.

The two pairs of support surfaces forming the seats 249 are fastened to profiles 250 or other structural elements, connected by means of bars 2. In the example illustrated in the attached drawing, the two profiles of each carriage section 1 are connected to each other by means of two bars 2, but it should be understood that in other embodiments a different number of connecting bars 2 may be provided, for instance also just one suitably shaped bar, or three or more substantially parallel bars 2.

In FIGS. 3-11 only one embossing roller R is shown, that can be any one of the embossing rollers 207, 209, 251-257. The carriage 247 also comprises an auxiliary section 3, connected to one of the farthest sections 1 of the series of sections 1 connected together.

Figures 3, 3A:
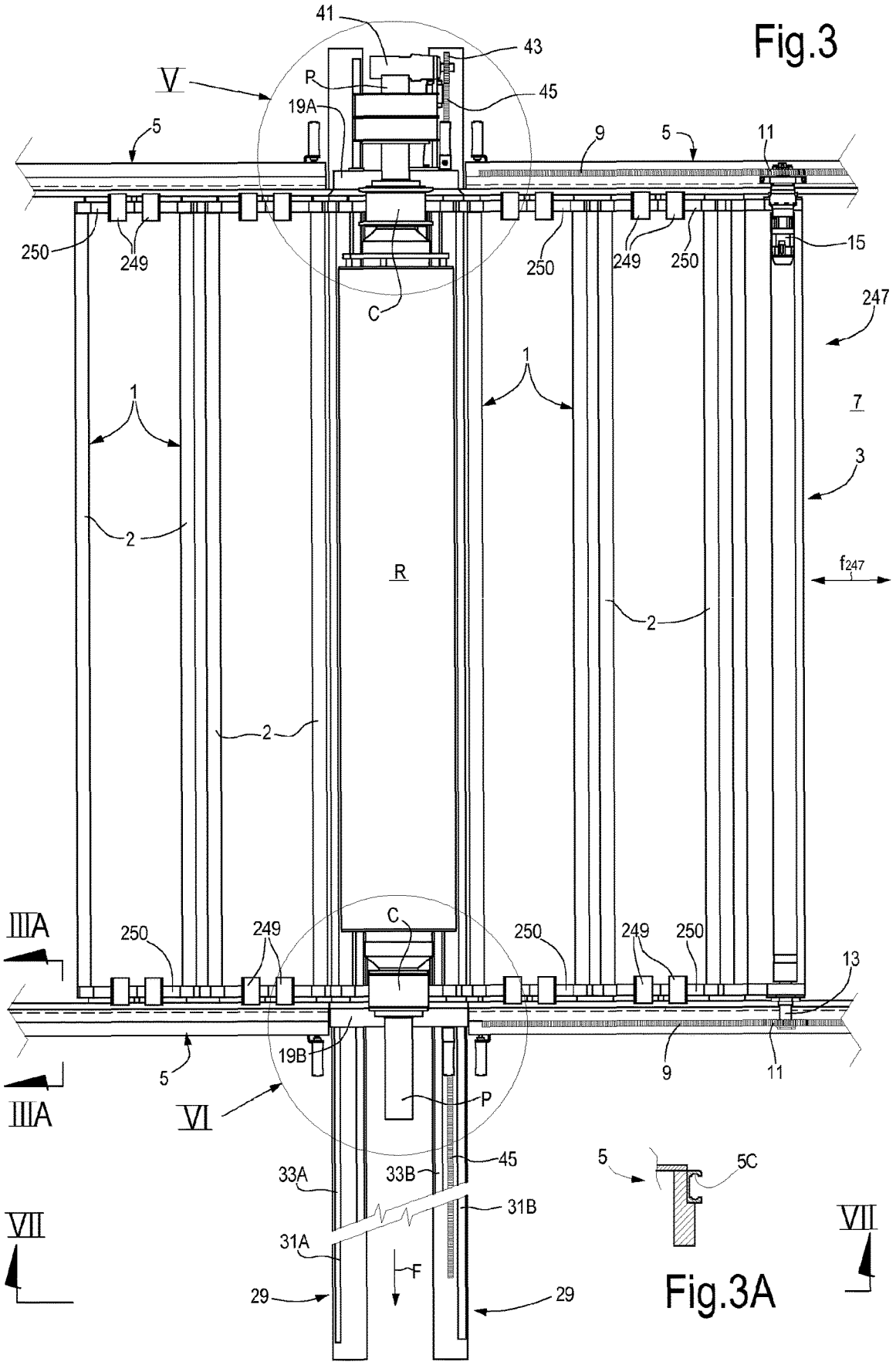
FIG. 3 is a plan view of the magazine with a roller arranged on one of the seats of a carriage arranged inside the magazine.
FIG. 3A shows a cross-section according to $III_A$-$III_A$ of FIG. 3.
Figure 4:
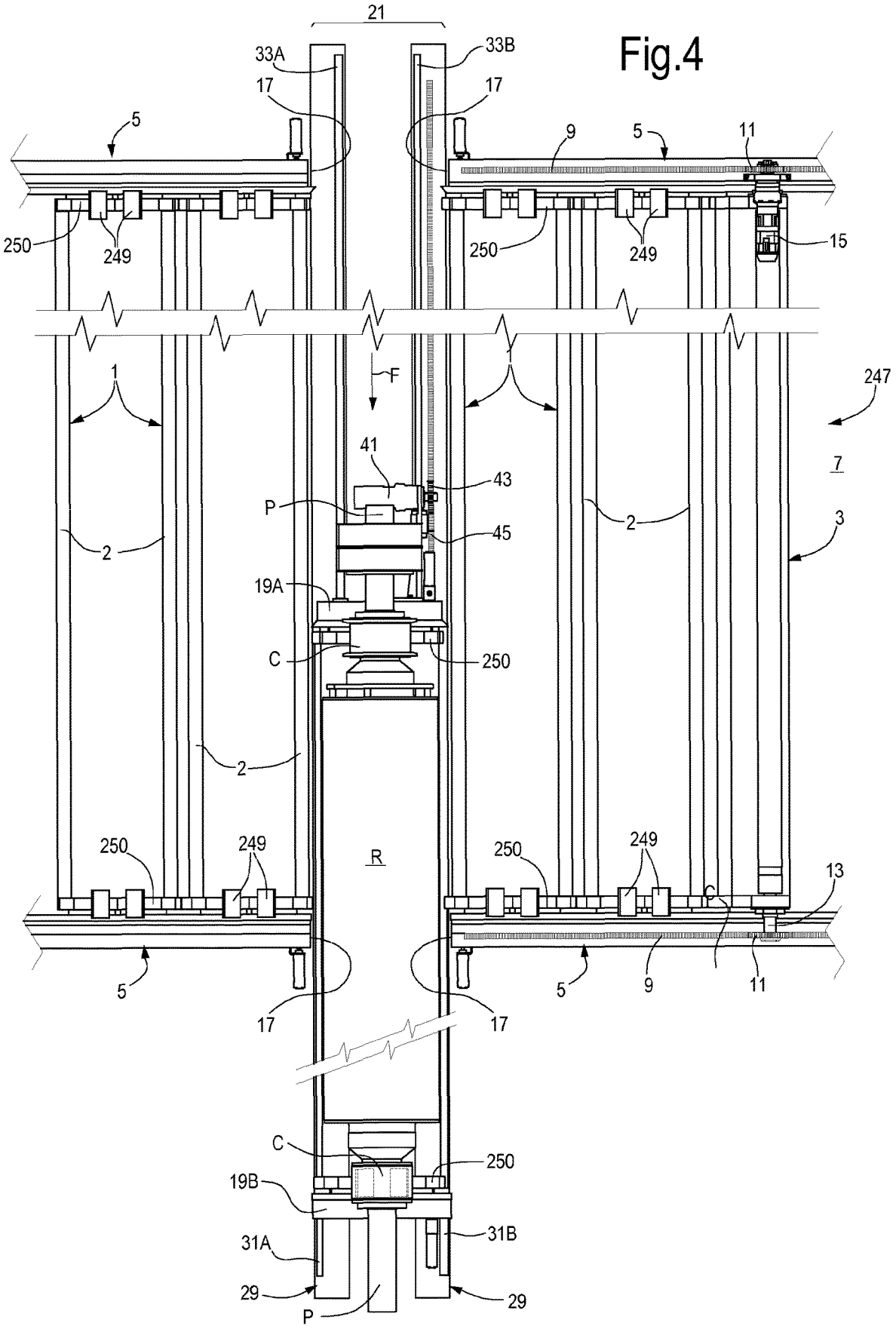
FIG. 4 is a plan view similar to that of FIG. 3, in a step of extracting a section of the support carriage for the rollers.

The carriage 247 is arranged in a translation space 7 for the carriage 247, defined between two longitudinal parallel guides 5, see in particular FIGS. 3 and 4. In the illustrated embodiment, each longitudinal guide 5 is provided with a rack 9 engaging a respective pinion 11. The two pinions 11 are coaxial and keyed on a shaft 13, that can be driven into rotation by means of a motor 15 controlling the movement in the handling direction f247 of the carriage 247. The motor 15 and the shaft 13, with the respective supports, may be mounted on the auxiliary section 3 of the carriage 247.

In other embodiments, different mechanisms can be used for moving the carriage 247 in the handling direction f247, for example belt systems, threaded bar systems or other systems.

Each of the longitudinal guides 5 has a gap 17 (see in particular FIG. 5) in an intermediate position along the longitudinal extension thereof, for example, but without limitation, at approximately the middle thereof. The gap 17 define an extraction and insertion station for extracting and inserting the sections 1 forming part of the carriage 247. Two longitudinal guide portions 19A, 19B are inserted in the gaps 17; the guide portions are so configured as to engage, each time, one of the sections 1 that are moved in an insertion and extraction direction F as described below. The extraction and insertion station is schematically indicated with 21 (FIG. 4). The longitudinal guide portions 19A, 19B are connected to each other by means of bars 20, see in particular FIGS. 8 and 9. In the illustrated example, three bars 20 are provided, but in other embodiments a different number of bars 20 may be provided, for example one, two, four or more bars 20.

Each section 1 of the carriage 247 comprises engagement elements 23 for engaging with the longitudinal guides 5. In the illustrated embodiment, the longitudinal guides 5 have a C-shaped profile 5C (see FIGS. 3, 3A) and the engagement elements 23 comprise wheels that are inserted in the profiles 5C. Each section 1 advantageously comprises a plurality of wheels for each guide 5. In other embodiments, the engagement elements 23 may be differently configured, for example in the form of shoes engaging with prismatic longitudinal guides 5.

Figure 10:
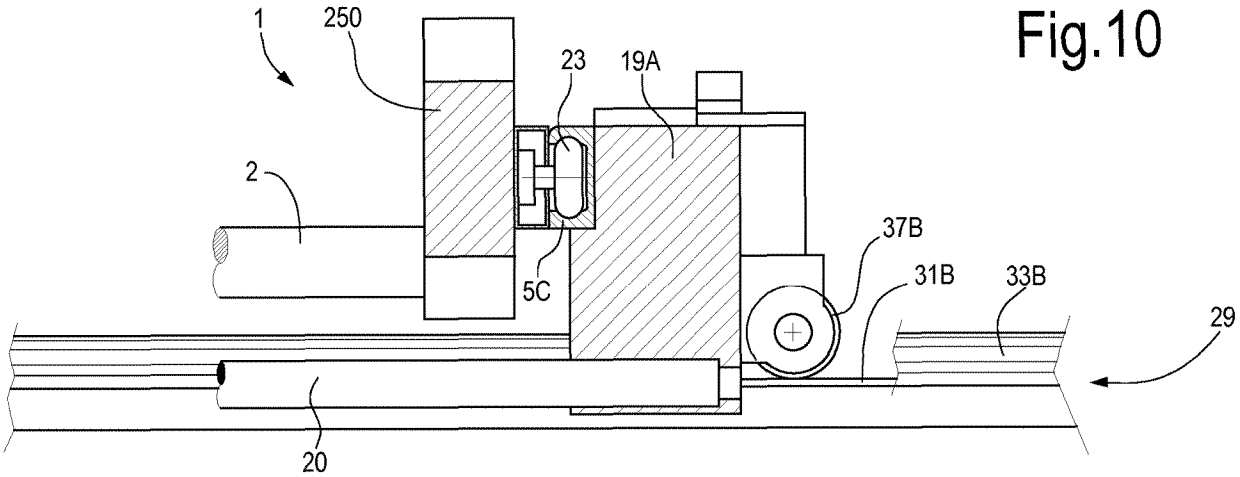
FIGS. 10 and 11 show cross-sections according to X-X and XI-XI of FIG. 9.
Figure 11:
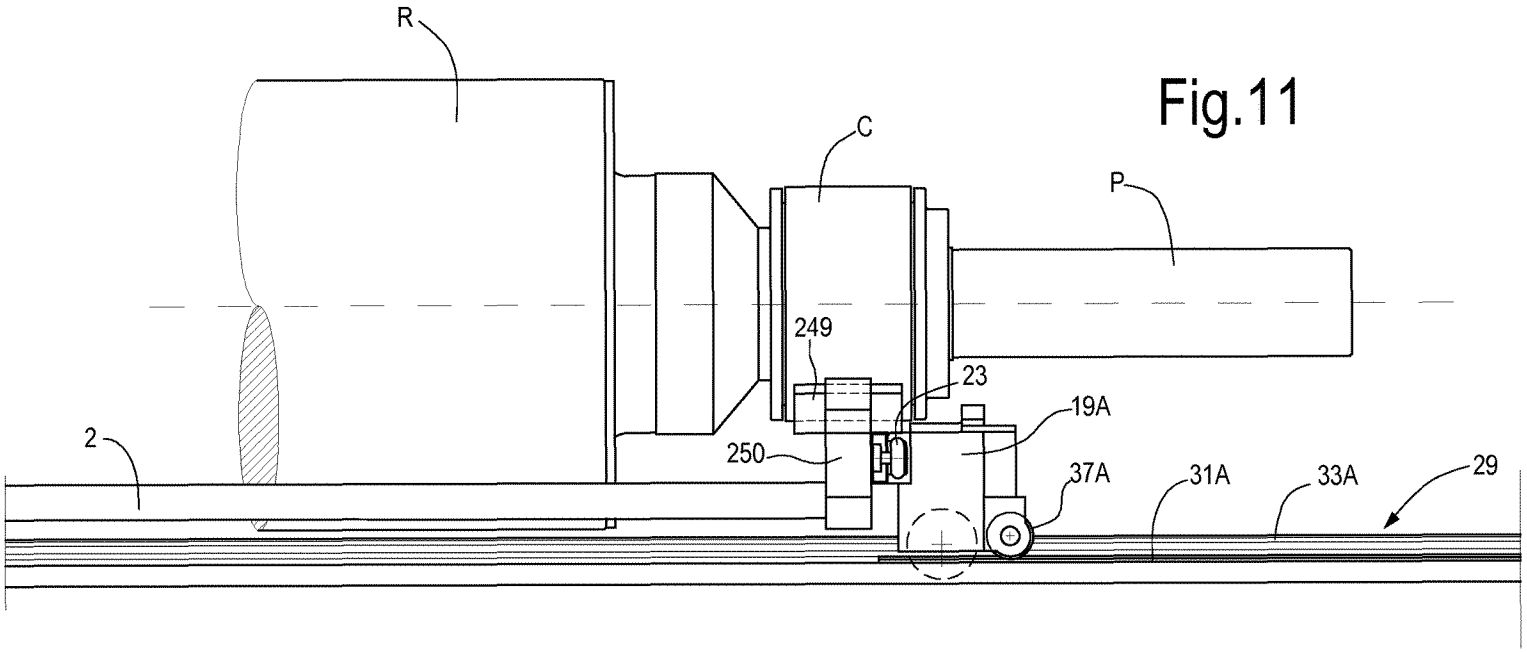

The longitudinal guide portions 19A, 19B have such a shape as to be engaged by the same engagement elements 23, see for example FIGS. 10 and 11. For example, the longitudinal guide portions 19A, 19B may have a C-shaped profile equal or substantially equal to the profile 5C of the longitudinal guides 5.

In other embodiments, the engagement elements 23 and the guides 19A, 19B may be made in a different way. For example, the guides 19A, 19B may be dovetailed, or may have any other suitable shape, and the engagement elements 23 may be shoes sliding engaging with the guides.

When the longitudinal guide portions 19A, 19B are inserted in the gaps 17 of the longitudinal guides 5, they form with these latter two continuous longitudinal guides, so that the various sections 1 of the carriage 247 may translate along the whole length of the translation space 7 of the carriage 247. To this end, the longitudinal guide portions 19A, 19B have C-shaped profile segments, indicated again with 5C and forming a C-shaped continuous profile when the longitudinal guide portions 19A, 19B are aligned with the longitudinal guides 5.

The sections 1 can be connected to one another and to the auxiliary section 3 by means of a fast coupling and releasing system. The sections 1 and 3 preferably have connecting members that can be coupled to one another by means of a simple mutual movement of the sections 1, 3 in the insertion and extraction direction F (FIGS. 3, 4). The insertion and extraction direction F is substantially orthogonal to the handling direction f247 of the carriage 247 in the space 7 of the magazine.

In the illustrated embodiment, each section 1 has, at both the sides thereof, i.e. adjacent to both the guides 5, two appendices 25, 27, each of which defines a groove extending in the insertion and extraction direction F of the sections 1 of the carriage 247. The grooves defined by the two appendices 25, 27 face opposite: the groove formed by the appendix 25 is opened downwards, while the groove formed by the appendix 27 is opened upwards. In this way, two appendices 25, 27 may be mutually coupled and released by means of a simple movement according to the direction F.

With this arrangement, it is possible to insert each section 1 into, and to extract it from, the translation space 7 with a movement according to the arrow F, which movement causes the automatic coupling of the section 1 to, or the automatic releasing thereof from, the adjacent sections. Each section 1 of the carriage 247 may be extracted from the magazine 245 independently of the two sections 1 adjacent thereto, and may be inserted again or replaced with another section 1 in the same position.

In order to insert and extract each section 1 in a simple way, the section arranged in the extraction station 21 remains advantageously engaged with the two longitudinal guide portions 19A, 19B by means of the engagement members 23; see FIGS. 10 and 11. By inserting the engagement elements 23 of the section 1 arranged in the extraction station 21 in the longitudinal guide portions 19A, 19B, the section 1 is engaged to the guide portions 19A, 19B. The longitudinal guide portions 19A, 19B are, thus, extracted in the insertion and extraction direction F together with the section 1.

In some embodiments, each longitudinal guide portion 19A, 19B may be associated with engaging members for engaging with a transverse guide system 29 extending parallel to the insertion and extraction direction F. The transverse guide system 29 may comprise one or more tracks, channels or other longitudinal guide elements, parallel to one another, with which shoes, wheels or other engagement members engage, which are fastened to the two longitudinal guide portions 19A, 19B.

For example, two parallel tracks may be provided, with which shoes or wheels co-act, which are in turn fastened to the two longitudinal guide portions 19A, 19B. Alternatively, the guide system may comprise a roller conveyor fixed to the ground, co-acting with engagement members for engaging with the roller conveyor and that are integral with the longitudinal guide portions 19A, 19B.

Figure 8:
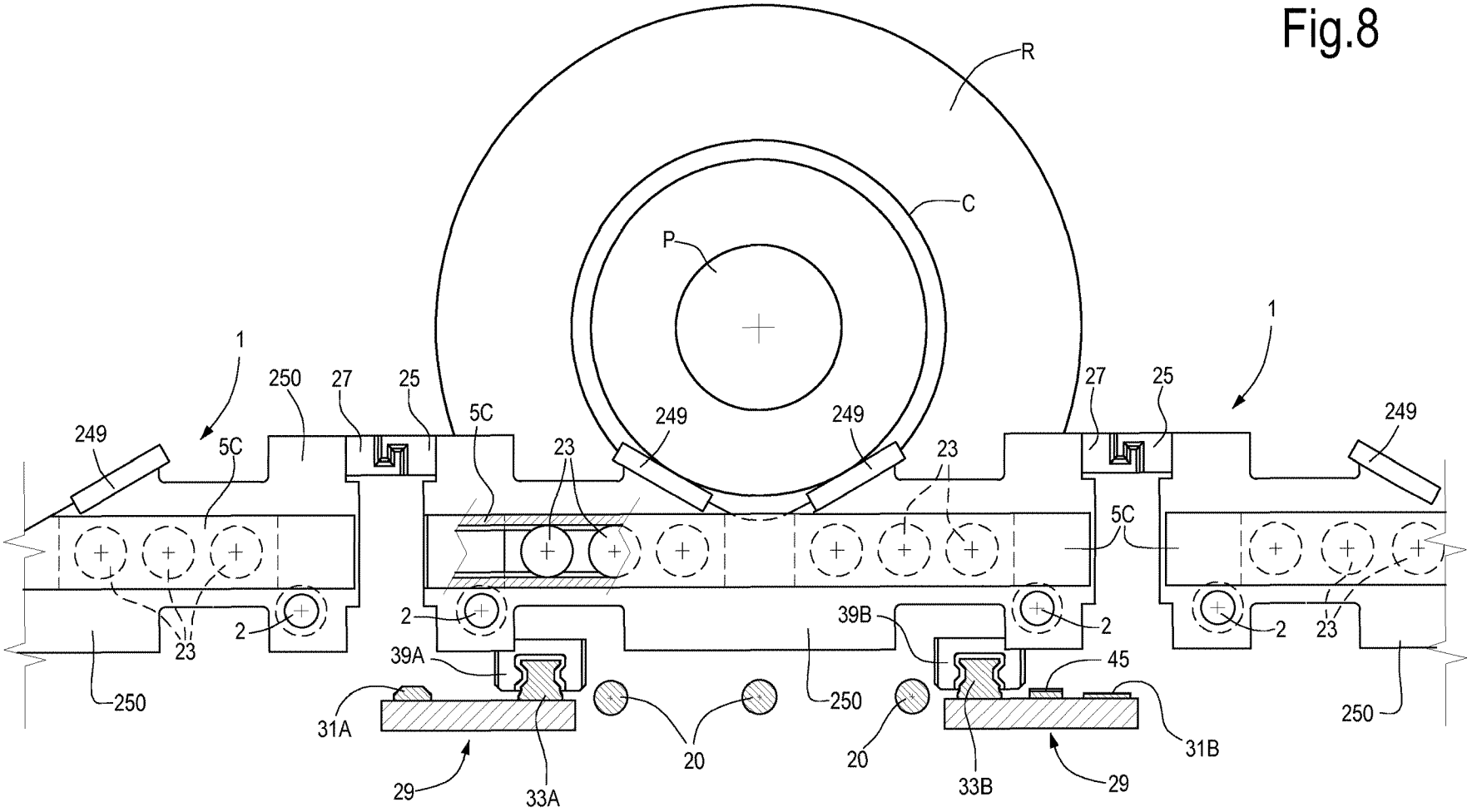
FIGS. 8 and 9 are cross sections according to VIII-VIII and IX-IX of FIG. 6.
Figure 9:
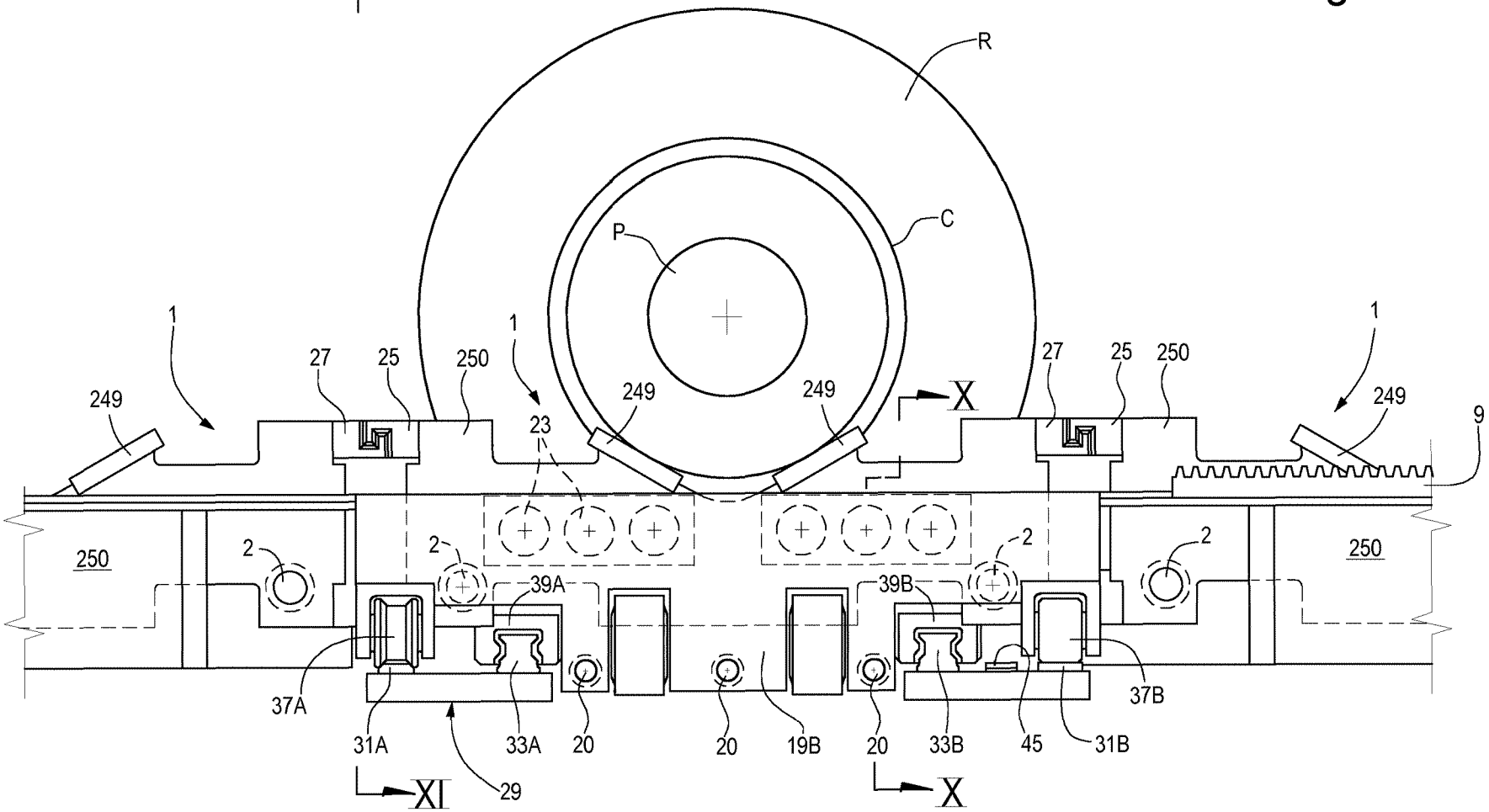

In the illustrated embodiment, a more complex transverse guide system 29 is provided, comprising a pair of outer tracks 31A, 31B and a pair of inner tracks 33A, 33B, arranged between the outer tracks 31A, 31B and parallel thereto (see in particular FIGS. 8 and 9). Shaped wheels 37A, 37B, carried by the longitudinal guide portion 19B, may engage with the outer tracks 31A, 31B. Shoes 39A, 39B, integral to the longitudinal guide portion 19A, may engage with the inner tracks 33A, 33B (see also FIGS. 5, 5A, 5B).

Figure 5B:
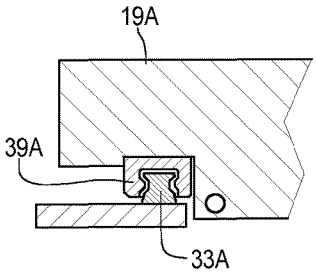
FIGS. 5A, 5B are cross-sections according to $V_A$-$V_A$ and $V_B$-$V_B$ of FIG. 5.
Figure 5A:
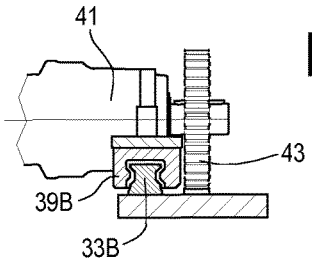
Figure 5:
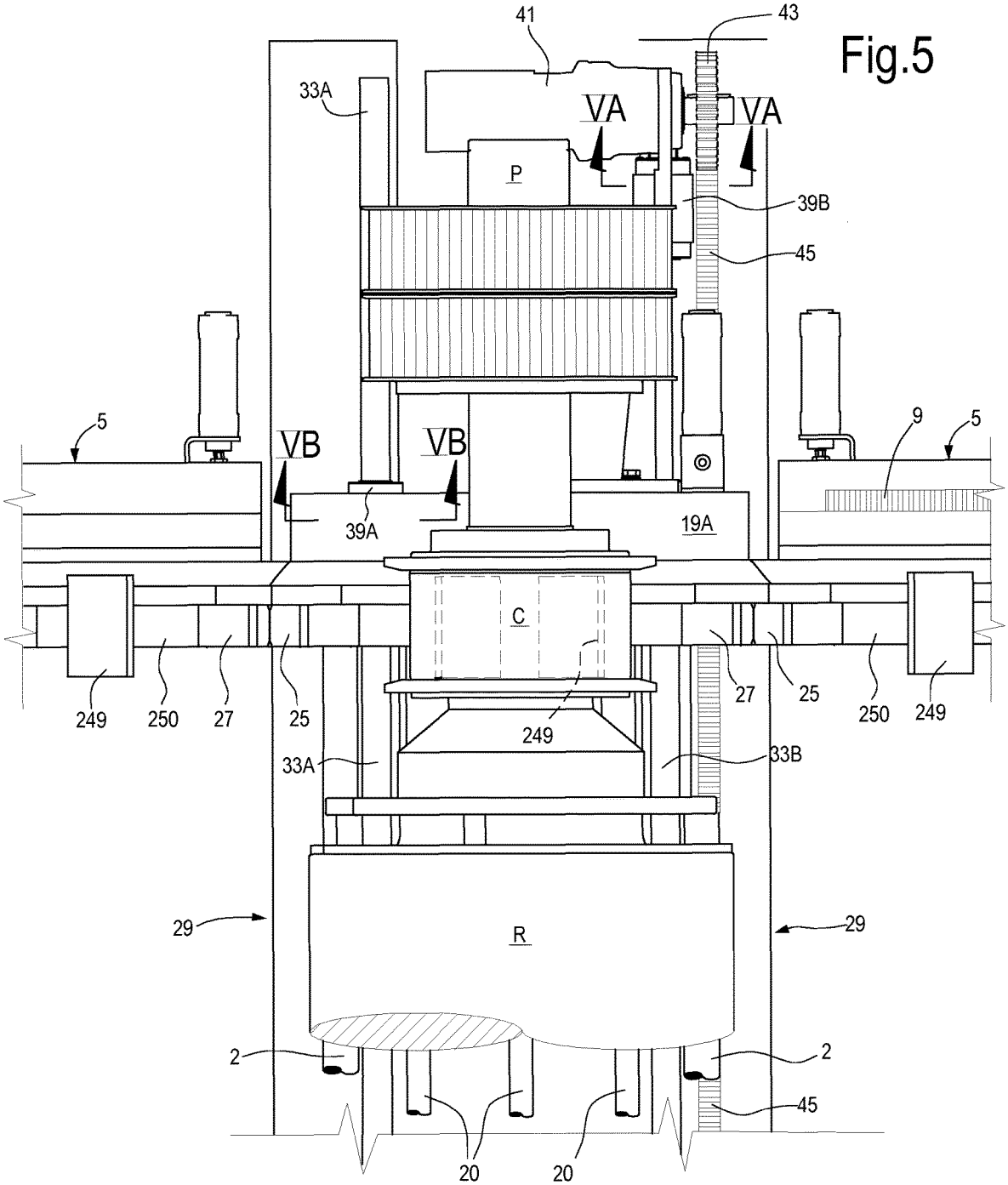
FIG. 5 shows an enlargement of the detail indicated with V in FIG. 2.
Figure 6:
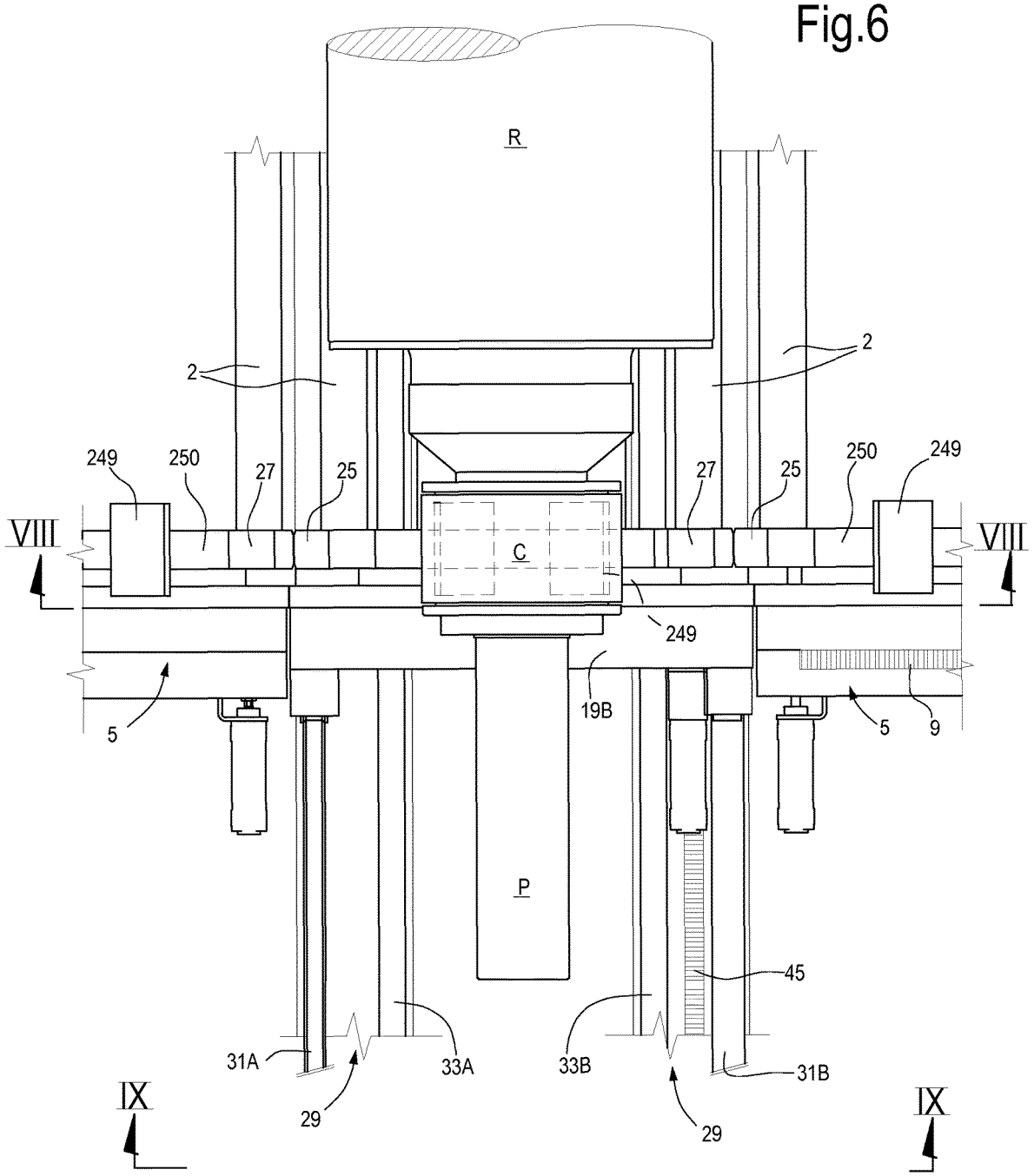
FIG. 6 is an enlargement of the detail indicated with VI in FIG. 3.
Figure 7:
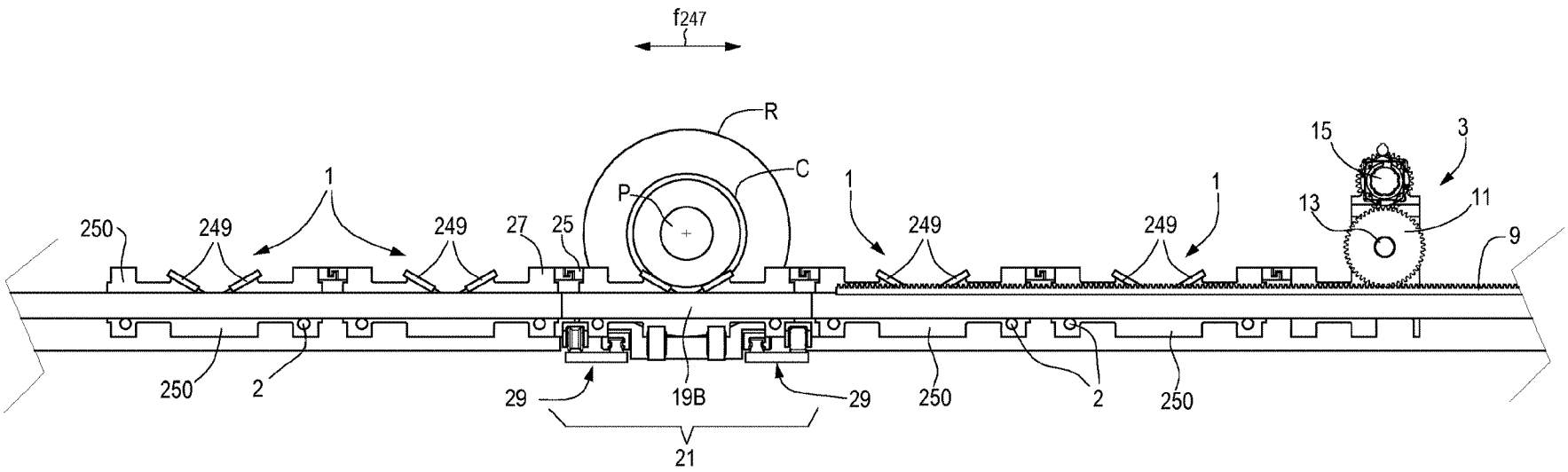
FIG. 7 is a front view according to VII-VII of FIG. 3.

As shown in FIGS. 5, 5A, 5B, the shoes 39A, 39B may be staggered with respect to each other in the extraction direction F, in order to ensure better support and better reaction forces.

A motor 41, driving a pinion 43, is fastened to the longitudinal guide portion 19A. The pinion 43 meshes with a rack 45, which may be integral with the transverse guide system 29. In the illustrated example, the rack 45 is adjacent and parallel to the track 33B. In this way, the rotation of the motor 41 causes the translation of the section 1, which is aligned with the extraction station 21, in the extraction direction F.

With the described arrangement, the carriage 247 may operate as described below in order to replace embossing rollers arranged in the magazine 245. The carriage 247 is translated, by means of the motor 15, according to arrow f247 until the section 1 to be extracted has achieved the extraction station 21. The movement is along the longitudinal guides 5, whose intermediate gap 17 has been closed by means of the guide portions 19A, 19B temporarily aligned with the longitudinal guides 5 and connected to each other by means of the bars 20. When the section 1, that shall be extracted for example in order to remove and replace the embossing roller R arranged in the seat 249, is position in the extraction station 21, the motor 41 is actuated. This moves the selected section 1 along the transverse guide system 29. The shoes 39A, 39B give suitable reaction forces for guiding the movement under the thrust of the pinion 43 co-acting with the rack 45. The section 1 is temporarily connected, by means of the engagement elements 23, to the two longitudinal guide portions 19A, 19B, which substantially form a slide together with the bars 20 and with the engagement members (shoes 39A, 39B, shaped wheels 37A, 37B) for engaging with the transverse guide system 29. In this way, the section 1 and the longitudinal guide portions 19A, 19B, connected to each other by means of the bars 29, move as a single slide in the direction F. The section 1, with the embossing roller R supported in the respective seat 249, is supported by means of the shoes 33A, 33B and the wheels 31A, 31B along the transverse guide system 29. The extraction movement according to the arrow F automatically causes the release of the section 1 fastened to the longitudinal guide portions 19A, 19B from the two adjacent sections 1, thanks to the shape of the mutual connecting members 25, 27.

Once the section 1 of the carriage 247 has been brought outside the translation space 7 between the two longitudinal guides 5, it is outside the space of the embossing device where the magazine 245 is incorporated. In this position, the embossing roller R arranged on the extracted section 1 can be removed and replaced with another embossing roller. In this step, handling of the embossing rollers may be performed in a known manner, for example by means of a bridge crane, or by means of a ground handling system.

Once the embossing roller R has been replaced, the section 1 may be inserted again in the translation space 7, with an operation opposite to that described for the extraction thereof, bringing the longitudinal guide portions 19A, 19B aligned again with the longitudinal guides 5. This restores the continuity of the longitudinal guides and allows the translation of the carriage 247 according to arrow f247, in order to bring a different section 1 to the extraction station, if necessary.

With such a configured magazine and carriage 247 it is possible to replace, for example during the operation of the embosser, one or more embossing rollers of the magazine 245 with other embossing rollers, in a simple and fast way.

The magazine 245 may be provided with closing systems, for example a side wall and/or an upper wall, in order to protect the embossing rollers contained therein, especially against dust and cellulose fibers that could fall from the plies V1, V2 processed by the embossing device 200. The closing systems may be opened when it is necessary to extract a section 1 of the carriage 247 from the magazine 245, or to insert it in the magazine.

Whilst in the embodiments described above the single sections 1 of the carriage 247 can be mutually connected and released by a simple movement according to the insertion and extraction direction F, thanks to the grooves 25, 27 in other embodiments it is possible to connect the sections 1 to one another and to the auxiliary sections 3 by means of different mechanical members, with fastening and releasing actuators, if necessary. For example, coupling members may be provided, which connect to one another in order to join the sections 1 and which disconnect from one another by means of a suitable actuator. The actuator may be for example arranged in fixed position in the station 21, or a respective actuator may be provided on each section 1 and, if necessary, on the auxiliary section 3.

The invention claimed is:

1. A magazine for embossing rollers comprising:

a plurality of support seats for embossing rollers, adjacent to one another according to an alignment direction;

a guide system for guiding the seats in a handling direction;

wherein the seats are provided with mutual connecting members so as to be connected to, and released from, one another, in order to extract each of the seats from the magazine independently of another one of the seats.

2. The magazine according to claim 1, wherein said seats are extracted from, and inserted into, the magazine by means of a movement according to an insertion and extraction direction not parallel to the handling direction.

3. The magazine according to claim 2, wherein the mutual connecting members are configured to allow mutual connection and release of the seats by means of a connecting and releasing movement according to the insertion and extraction direction.

4. The magazine for embossing rollers according to claim 3, wherein the insertion and extraction direction is substantially orthogonal to the handling direction.

5. The magazine for embossing rollers according to claim 2, wherein the insertion and extraction direction is substantially orthogonal to the handling direction.

6. The magazine for embossing rollers according to claim 1, wherein the seats are provided in sections of a carriage that is movable in the magazine according to the alignment direction.

7. The magazine for embossing rollers according to claim 6, wherein the guide system comprises two longitudinal parallel guides defining therebetween a translation space for the carriage, and wherein each of the seats of the carriage is provided with engagement elements for engaging with the longitudinal guides.

8. The magazine for embossing rollers according to claim 7, wherein each of said two longitudinal parallel guides has a gap in an intermediate position along a longitudinal extension thereof; each said gap of the two longitudinal parallel guides being aligned in the insertion and extraction direction and defining an extraction and insertion station for extraction of the seats from, and insertion of the seats into, the translation space.

9. The magazine for embossing rollers according to claim 8, further comprising two longitudinal guide portions, which can be separated from the two longitudinal parallel guides and are configured so as to be inserted in the gaps of the longitudinal parallel guides and aligned therewith, so as to form continuous longitudinal guides.

10. The magazine for embossing rollers according to claim 9, wherein the two longitudinal guide portions are connected to one another by connection bars.

11. The magazine for embossing rollers according to claim 9, wherein the two longitudinal guide portions are selectively coupled to one of the seats which is positioned in the extraction and insertion station.

12. The magazine for embossing rollers according to claim 11, wherein at least one of said longitudinal guide portions is connected to a first motor, configured and arranged to move the longitudinal guide portions, and a seat connected thereto, in the insertion and extraction direction.

13. The magazine for embossing rollers according to claim 8, further comprising a transverse guide system to move the seats in the insertion and extraction direction, the transverse guide system extending in the extraction and insertion station.

14. The magazine for embossing rollers according to claim 13, wherein each of the longitudinal guide portions is provided with engaging members for engaging with the transverse guide system.

15. The magazine for embossing rollers according to claim 1, wherein the seats are fastened to a motorized auxiliary section, provided with a second motor to move the seats in the handling direction.

16. An embossing device comprising:

a bearing structure;

at least one embossing roller provided with embossing protuberances;

at least one pressure roller defining, with the embossing roller, an embossing nip;

a magazine for embossing rollers according to claim 1, integrated in the bearing structure.

17. The embossing device according to claim 16, further comprising a handling member to transfer embossing rollers from and towards said magazine for embossing rollers.

* * * * *